United States Patent [19]

Josefsson

[11] Patent Number: 4,932,316

[45] Date of Patent: Jun. 12, 1990

[54] PAINT SPRAY BOOTH WITH MOVABLE INNER WALLS

[75] Inventor: Leif E. B. Josefsson, Sterling Heights, Mich.

[73] Assignee: Flakt, Inc., Madison Heights, Mich.

[21] Appl. No.: 343,428

[22] Filed: Apr. 26, 1989

[51] Int. Cl.[5] ..... B05B 15/12

[52] U.S. Cl. ..... 98/115.2

[58] Field of Search ..... 98/31.5, 31.6, 33.1, 98/34.5, 34.6, 40.1, 40.11, 115.2; 52/238.1, 243.1, 39; 118/326

[56] References Cited

U.S. PATENT DOCUMENTS

| | | | |
|---|---|---|---|
| 1,520,796 | 12/1924 | Bartling | 98/115.2 |
| 1,697,079 | 1/1929 | Onsrud | 98/115.2 |
| 1,876,528 | 9/1932 | Walters | 52/243.1 |
| 2,761,373 | 9/1956 | Owen | 98/115.2 |
| 3,824,912 | 7/1974 | Jensen et al. | 98/115.2 |
| 4,241,646 | 12/1980 | Tsuruta et al. | 98/115.2 |
| 4,338,364 | 7/1982 | Kennon et al. | 427/424 |
| 4,608,066 | 8/1986 | Cadwell, Jr. | 98/31.5 X |
| 4,771,728 | 9/1988 | Bergman, Jr. | 34/4 |

FOREIGN PATENT DOCUMENTS

| | | | |
|---|---|---|---|
| 0021209 | 1/1981 | European Pat. Off. | 98/115.2 |
| 2936367 | 3/1981 | Fed. Rep. of Germany | 118/326 |
| 3640699 | 6/1988 | Fed. Rep. of Germany | 98/115.2 |
| 1212617 | 2/1986 | U.S.S.R. | 98/115.2 |

OTHER PUBLICATIONS

Ford Motor Company Request for Quotation, Purchase Order and Sketch dated Oct. 11, 1988.

*Primary Examiner*—Harold Joyce

*Attorney, Agent, or Firm*—Harness, Dickey & Pierce

[57] ABSTRACT

A paint spray booth enclosure having fixed, outer walls and movable, inner walls. Many inner walls throughout the length of a paint spray booth enclosure could be placed such that the total air volume moving through the work stations inside the paint spray booth enclosure would be minimized, thus lowering energy costs and capital investment for related equipment.

9 Claims, 2 Drawing Sheets

PAINT SPRAY BOOTH WITH MOVABLE INNER WALLS

BACKGROUND OF THE INVENTION

1. Field of the Invention

The present invention generally relates to an improvement for paint spray booths and, more particularly, is concerned with a product for minimizing the controlled air space inside paint spray booths.

Paint spray booths are usually found in production lines for products such as automobiles. Parts of the automobile which must be painted are conveyed into the enclosed booth and the desired paint is applied by spraying the paint on to the parts either manually or through the use of robotics.

Between 25 and 60 percent of the paint never reaches the part being painted but appears as overspray in the air. The overspray must be removed from the booth for a variety of reasons. It cannot be allowed to fall back on the painted body or the interior of the booth. Removal of the overspray is best met if the booth is provided with a vertical, laminar air flow with sufficient air velocity. The air enters the booth through a perforated ceiling, usually made of a wire mesh, and flows down through a perforated floor, usually steel grating, thereby creating a constant draft. In many conventional systems, downward draft carries the overspray through the floor where it mixes with water to be disposed of as sludge.

Since paint spray booths can be hundreds of feet long with many work stations along the way, it is desirable to be able to apply different colors of paint to the parts as they pass through the booth. Cross contamination of colors should be avoided by preventing the paint at each work station from drifting through the overspray to the next work station.

Temperature and humidity conditions in the booth must also be monitored very closely. Certain paints, for instance, require very accurate control of these two variables.

Another concern of paint spray booths are emissions into the atmosphere. Federal Law regulates these emissions. In order to reduce the concentration of paint particles in the air exhausted to the environment, the air leaving through the floor of the paint spray booth must be cleaned.

Removing overspray, controlling air temperature and humidity, and cleaning paint particles from the exhaust air requires an enormous amount of energy. These energy needs can be very expensive. Reducing the energy required for each of the aforementioned concerns and lowering capital investment for related equipment can be accomplished by minimizing the total air volume inside the paint spray booth work stations.

SUMMARY OF THE INVENTION

The present invention provides a product designed to satisfy one or more of the aforementioned concerns. In accordance with the teachings of this invention a paint spray booth enclosure is provided having fixed, outer walls and adjustable means for minimizing the controlled air space in the booth. The present invention consists of movable, inner walls for the booth which can be placed around a work station in such a way as to allow room for the work to be accomplished yet keeping the total area of the work station at a minimum. In a booth with many work stations the inner walls could be staggered throughout the length of the booth in such a way that each work station would have its own minimum area.

The inner walls could be constructed of a lightweight material which would allow for easy manual placement inside the booth. If a different product line is going to make use of the booth the inner walls could be adjusted accordingly to accommodate the different parts. Therefore, air volume and thus energy consumption and capital investment, can be minimized for any particular project.

BRIEF DESCRIPTION OF THE DRAWINGS

The objects and features of the invention will become apparent from a reading of the detailed description of a preferred embodiment, taken in conjunction with the drawings, in which.

DESCRIPTION OF THE PREFERRED EMBODIMENT

Figure 1:
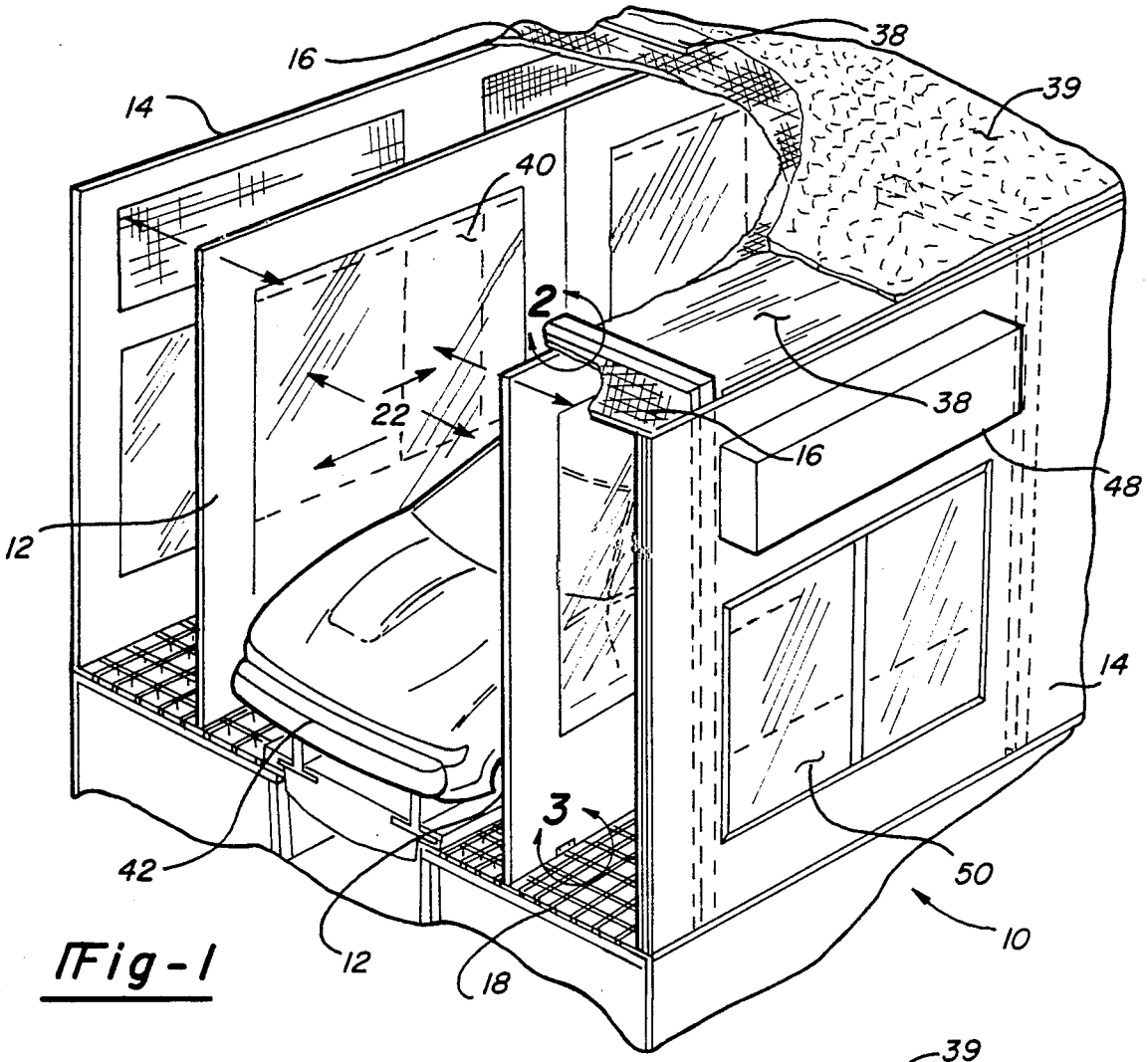
FIG. 1 is a perspective view of one work station inside a paint spray booth showing the movable, inner walls and the fixed, outer walls.

Referring now to the drawings, and more particularly FIG. 1, there is shown a paint spray booth, generally designated 10, with adjustable means 12 for reducing air space in the booth 10. The booth 10 preferably includes fixed, outer walls 14, a wire mesh ceiling 16, a grated floor 18, and movable inner walls 12. The outer walls 14, usually have windows 50 and light fixtures 48 for monitoring the paint application from outside the booth 10. The inner walls 12 might also have windows 40.

Figure 2:
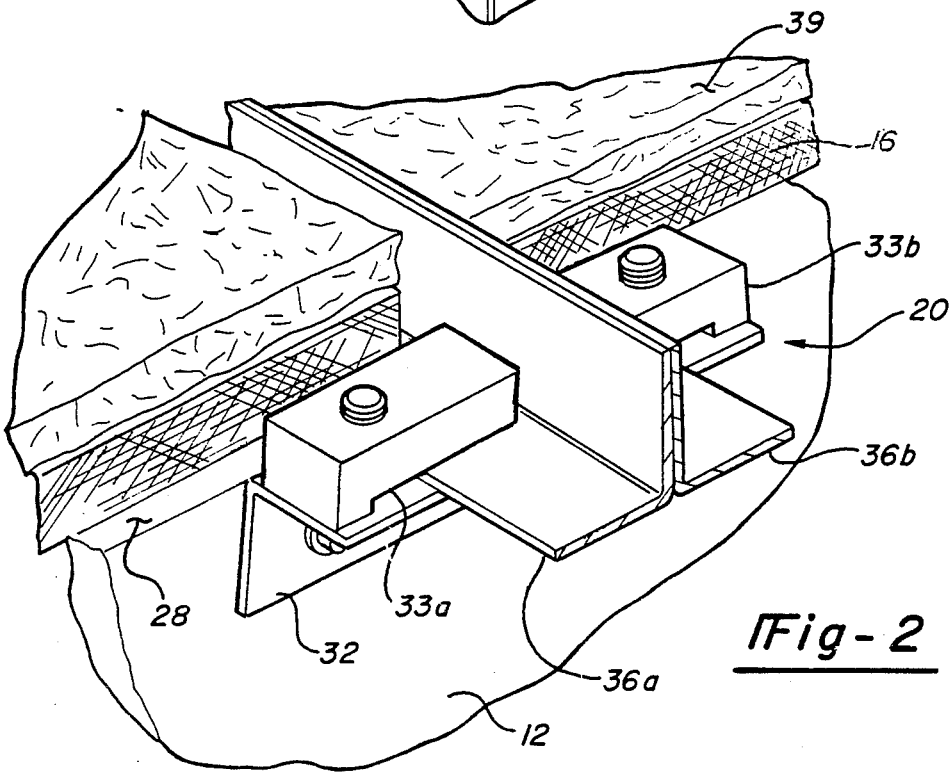
FIG. 2 is a perspective view showing one inner wall attachment to the ceiling frame inside the booth.

It is believed that the best method for assembling the inner walls 12 inside the booth 10 would be to attach the inner walls 12 at the top edge 28 and bottom edge 30 to the ceiling 16 and floor 18, respectively, using some simple connecting device, such as clamps, bolts, etc. Two connecting devices 20, may be securely fastened to the top edge 28 of the inner walls 12. One bracket 32 is shown attached to the inner wall 12 in FIG. 2. The bracket 32 is L-shaped and one side is bolted to the wall 12. The bracket 32 could be made of steel. The top exposed surface of the bracket 32 will be directly under the back-to-back L-shaped steel supporting members **36*a* and 36*b* which are a part of the ceiling structure. Two additional clamps 33*a* and 33*b* are loosely bolted to the top surface of the bracket 32 then positioned over the horizontal surface of the back-to-back L-shaped steel members 36*a* and 36*b*. The bolts are then tightened which causes the clamps 33*a* and 33*b* to grip the back-to-back L-shaped steel members 36*a* and 36*b*. Also shown in FIG. 2, is the fibrous filter 39 that rests upon the ceiling 16 and keeps the air flow, going through the ceiling 16**, clean.

Figure 3:
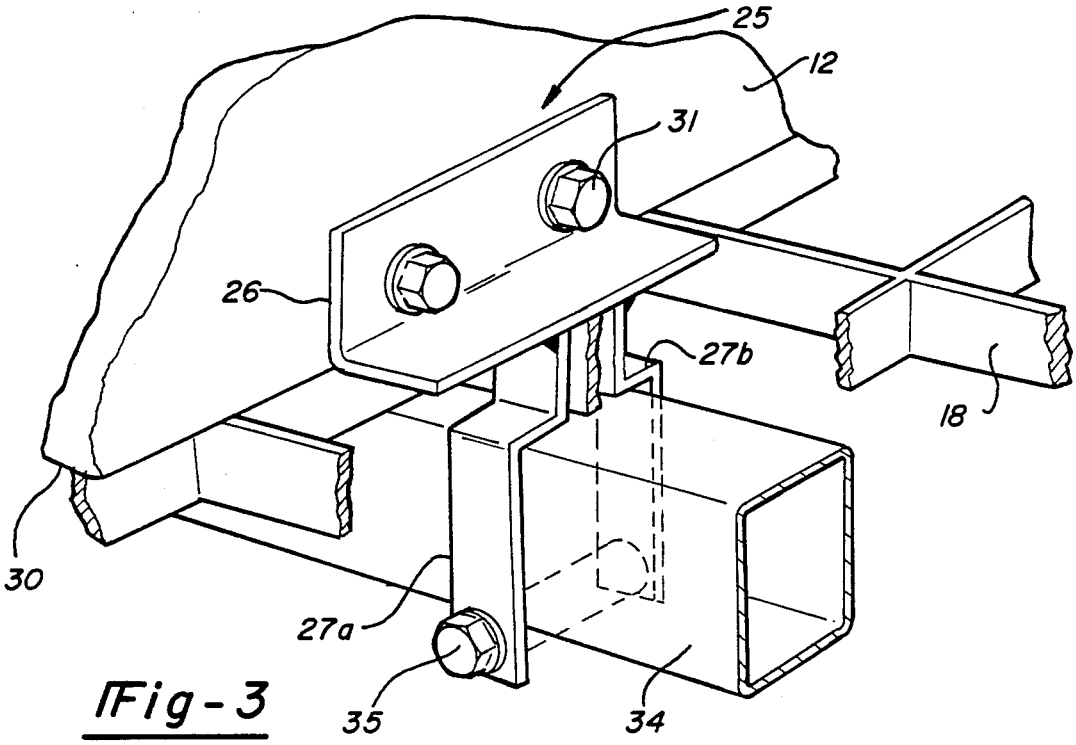
FIG. 3 is a perspective view showing one inner wall attachment to the floor frame inside the booth.

FIG. 3, shows a typical connecting device 25 for the bottom edge 30 of an inner wall 12. This device 25 consists of a bracket 26 which may be attached in two places on the bottom edge 30 of an inner wall 12. The brackets 26 would be bolted 31 to the wall 12. Two metal guides **27*a* and 27*b* are welded to the exposed, bottom surface of the bracket 26 as shown in FIG. 3. The metal guides 27***a* and 27*b* are positioned apart from each other and formed in such a way to fit around a structural tube steel member 34 in the floor 18. A bolt 35 is then placed through both metal guides 27*a* and 27*b* and tightened to securely hold the guides 27*a* and 27*b* to the tube steel 34. Of course, these attachment means may not work exactly as described in a different style paint booth. Other similar methods could be employed.

By keeping the connecting devices 20 and 25 simple it will require less time to move the inner walls 12. The inner walls 12 can then be adjusted in towards the center of the booth 10 or out towards the fixed walls 14 thereby varying the area of each work station 22 according to its needs. The inner walls 12 could be made of a lightweight material, such as aluminum, which would enable them to be manually moved from place to place to suit any particular painting project.

Figure 4:
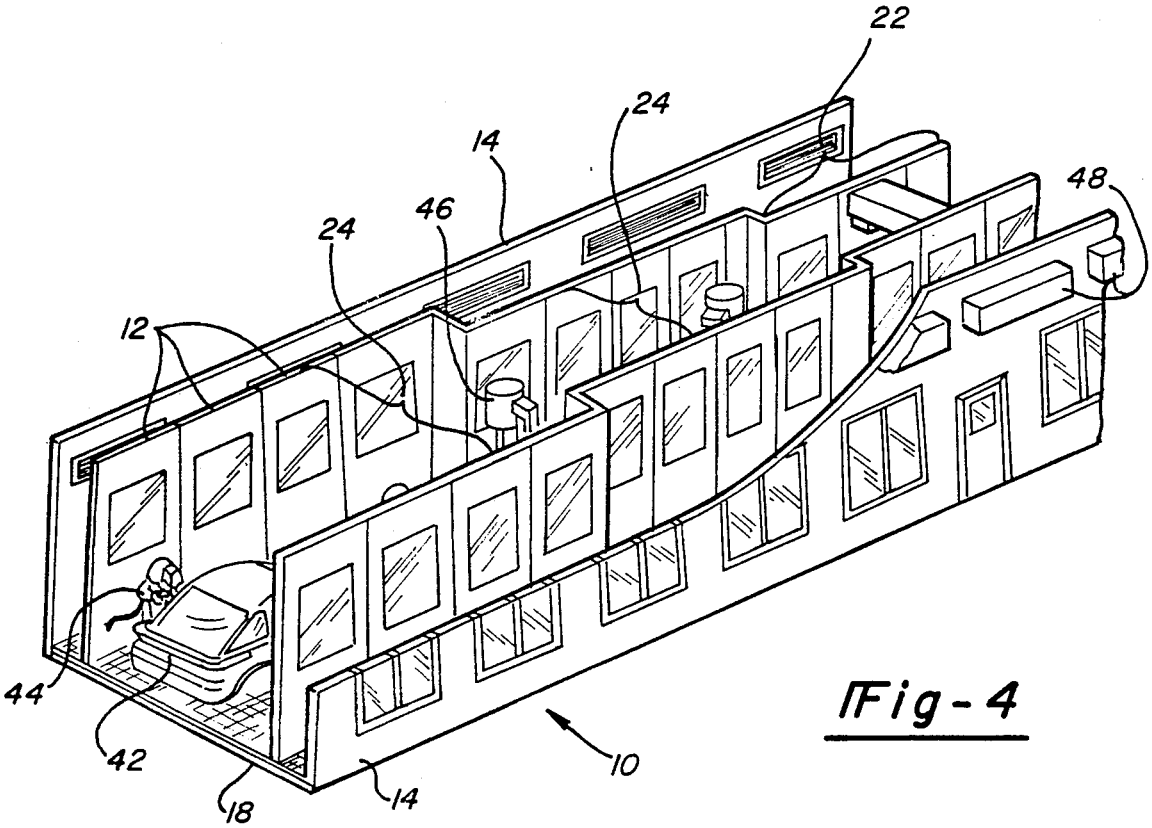
FIG. 4 is a perspective view showing a paint spray booth having many work stations.

Since production paint spray booths 10 may be hundreds of feet long, a plurality of inner walls 12 could be used in each paint booth 10, assembled and staggered in such a way to create a minimum air space 24 necessary at each work station 22 along the length of the booth 10 as shown in FIG. 4. To greatly reduce controlled air flow through the ceiling 16 in the space between the outer rewalls 14 and the inner walls 12, barrier plates 38 are placed on top of the ceiling 16 mesh covering all of the area between the outer walls 14 and the inner walls 12. These barrier plates 38 would preferably be made of galvanized sheet metal and be in sizes which would allow for one person to handle them. The barrier plates 38 have small holes in them which do allow some air flow to pass through. The idea is not to totally block off the air flow but to greatly reduce it. Some air flow is needed in case paint particles do slip into the area between the outer walls 14 and the inner walls 12. It is conceivable that, in any given project, a booth 10 may have many different sizes of controlled air zones 24, one for each work station 22. By constructing an area for a minimum volume of controlled air at each work station 22 energy consumption and the capital investment for equipment are thereby reduced.

The inner walls could be constructed with glass windows 40 in them. Portions of the inner walls 12 which are close to paint application equipment might also be electrically charged at the same polarity as that of the applied paint to prevent the paint from being attracted to the inner wall 12. The inner walls 12 should be located a sufficient distance from the part being painted 42 to allow room for a person 44 to operate the paint spray applicator or the inner walls 12 might be moved closer together if robotics 46 were operating the paint spray applicator.

It is believed that the paint spray booth 10 and the improvement of the present invention and many of its attendant advantages will be understood from the foregoing description, and it will be apparent that various changes may be made in the form and construction of the parts thereof without departing from the spirit and scope of the invention, the form described being merely a preferred or exemplary embodiment thereof.

What is claimed is:

1. An improved paint spray booth enclosure of the type having controlled air flow through a perforated ceiling and a perforated floor, wherein the improvement comprises:

outer walls;

a plurality of movable inner walls located interiorly of the outer walls; and means for blocking controlled air flow between the inner walls and the outer walls.

2. The booth of claim 1 wherein the inner walls may be positioned at various distances from the outer walls to suit the desired work space needed at each work station in the booth such that each work station in the booth may have a unique width with respect to other work stations in the booth.

3. The booth of claim 1 wherein the inner walls are made in sections, of sizes and weights which are capable of being manually moved.

4. The booth of claim 2 wherein the inner walls are made in sections, of sizes and weights which are capable of being manually moved.

5. The booth of claim 1 wherein said means for blocking controlled air flow comprises barrier plates positioned over portions of the perforated ceiling overlying the spaces between the inner walls and the outer walls such that controlled air flow may be greatly reduced in said spaces.

6. An improved paint spray booth enclosure of the type having a plurality of work stations and controlled air flow through a perforated ceiling and a perforated floor wherein the improvement comprises:

outer walls;

a plurality of movable, inner walls located interiorly of the outer walls for minimizing the controlled air space in the booth by positioning the inner walls at various distances from the outer walls to define a desired work space needed at each work station in the booth; and barrier plates positioned over portions of the perforated ceiling overlying the spaces between the inner walls and the outer walls such that controlled air flow may be greatly reduced in said spaces.

7. An improved paint spray booth enclosure of the type having a plurality of work stations, fixed, outer walls, and controlled air flow through a perforated ceiling and a perforated floor, wherein the improvement comprises:

movable, inner walls for minimizing the controlled air space in the booth;

the inner walls positioned at various distances from the outer walls to define a desired work space at each work station in the booth;

the inner walls made in sections of sizes and weights which are capable of being manually moved;

barrier plates positioned on the perforated ceiling in the space between the outer walls and the inner walls thereby greatly reducing controlled air flow through the ceiling in said space;

first means for removably coupling a top portion of each inner wall to the ceiling; and second means for removably coupling a bottom portion of each inner wall to the floor.

8. The booth of claim 7 wherein the first means for removably coupling comprises a bracket assembly bolted to the inner wall and designed to hang from existing structural members in the ceiling.

9. The booth of claim 7 wherein the second means for removably coupling comprises a bracket assembly bolted to the inner walls and designed to support from existing structural members in the floor.

* * * * *